US005713631A

United States Patent [19]

O'Neill et al.

[11] Patent Number: 5,713,631

[45] Date of Patent: Feb. 3, 1998

[54] DYNAMIC BACKREST SUPPORT SYSTEM

[75] Inventors: Hugh O'Neill, San Francisco, Calif.; Peter W. Linley, 49 Hawthorne Village Rd., Nashua, N.H. 03062

[73] Assignee: Peter W. Linley, Nashua, N.H.

[21] Appl. No.: 699,038

[22] Filed: Aug. 19, 1996

Related U.S. Application Data

[62] Division of Ser. No. 557,906, Nov. 14, 1995, Pat. No. 5,662,384.

[51] Int. Cl.[6] ..... A47C 4/54

[52] U.S. Cl. ..... 297/284.6; 297/284.9; 297/452.41; 297/DIG. 3

[58] Field of Search ..... 297/DIG. 3, 284.6, 297/284.4, 284.5, 284.9, 452.41, 452.3, 452.33, 452.34; 5/655.3, 653

[56] References Cited

U.S. PATENT DOCUMENTS

| | | | |
|---|---|---|---|
| D. 106,986 | 11/1937 | Manson . | |
| 2,582,439 | 1/1952 | Kavanaugh . | |
| 2,728,926 | 1/1956 | Emery . | |
| 3,112,956 | 12/1963 | Schick et al. | 297/452.41 X |
| 3,145,054 | 8/1964 | Sopko, Jr. | 297/284.6 X |
| 3,276,047 | 10/1966 | Emery | 297/452.41 X |
| 3,297,023 | 1/1967 | Foley . | |
| 3,540,776 | 11/1970 | Wilson | 297/284.6 X |
| 3,867,732 | 2/1975 | Morreli . | |
| 4,108,492 | 8/1978 | Kirby | 297/284.6 X |
| 4,190,286 | 2/1980 | Bentley | 297/284.5 X |
| 4,619,481 | 10/1986 | Grudzinskas . | |
| 4,655,505 | 4/1987 | Kashiwamura et al. . | |
| 4,759,543 | 7/1988 | Feldman | 297/284.6 X |
| 4,793,651 | 12/1988 | Inagaki et al. | 297/284.6 X |
| 4,796,948 | 1/1989 | Paul et al. . | |
| 4,840,425 | 6/1989 | Noble . | |
| 4,852,195 | 8/1989 | Schulman . | |
| 4,864,671 | 9/1989 | Evans . | |

(List continued on next page.)

OTHER PUBLICATIONS

Pegasus Airwave Limited, Portsmouth, Hampshire, PO3 5QT, Product Brochure on Pegasus Airwave System—6 sheets.

Kinetic Concepts, San Antonio, Texas, Product Brochure on TheraPulse Pulsating Air Suspension Therapy—12 sheets.

Embracing Concepts, Inc., Rochester, NY, Product Brochure on ISCH–DISH Pressure Relief Cushion—2 sheets.

Talley Group Limited, Romsey, Hampshire SO51 9AQ, England, Product Brochure on Sequential Seating Systems for Decubitus Ulcer Prevention and superior seating comfort—4 sheets.

(List continued on next page.)

*Primary Examiner*—Milton Nelson, Jr.
*Attorney, Agent, or Firm*—Edward B. Anderson

[57] ABSTRACT

A seating support cushion system has a seat cushion with an H-shaped inflatable cell, with the sides of the "H" extending parallel to a cushion axis that corresponds to the longitudinal axis of a person sitting on the cushion, and therefore parallel to the thighs. The crossbar cell is midway in the cushion, forward of the location of the position of the ischial tuberosities of a person supported on the cushion. A pair of inner cells fill in the voids of the "H" shape, with one cell in the rear of the cushion positioned for supporting the ischial tuberosities. This rear cell also preferably has a recess for receiving the coccyx without significant pressure, and a secondary crossbar portion adjacent to the crossbar cell. A back cushion has two sets of alternatingly inflated, laterally extending cells forming a spinal recess and contoured to conform to the shape of a person's back. The back cushion also has a pair of inflatable, opposing, and longitudinally extending side support cells positioned adjacent to the outer edges of the laterally extending back cells The inflation of the back and seat cells is coordinated so that the top of the pelvis is pressed forward at the same time that the ischial tuberosities are supported. The preischial crossbar cells provide support and resistance to movement of a seated person forward on the cushion.

13 Claims, 5 Drawing Sheets

U.S. PATENT DOCUMENTS

| | | | |
|---|---|---|---|
| 4,965,899 | 10/1990 | Sekido et al. . | |
| 5,022,385 | 6/1991 | Harza . | |
| 5,127,708 | 7/1992 | Kishi et al. . | |
| 5,129,704 | 7/1992 | Kishi et al. . | |
| 5,193,237 | 3/1993 | Holdredge . | |
| 5,277,474 | 1/1994 | Hannagan et al. . | |
| 5,283,735 | 2/1994 | Gross et al. . | |
| 5,320,409 | 6/1994 | Katoh et al. . | |
| 5,369,828 | 12/1994 | Graebe . | |
| 5,379,471 | 1/1995 | Holdredge . | |
| 5,396,671 | 3/1995 | Stacy | 5/655.3 |
| 5,558,398 | 9/1996 | Santos | 297/284.6 X |

OTHER PUBLICATIONS

Embracing Concepts, Inc., Rochester, NY, Product Brochure on ISCH–DISH Pressure Relief Cushion—4 sheets 1994.

Grant Airmass Corporation, Stamford, CT, Product Brochure on Alternating Pressure–Relief Seat Pad—2 sheets.

Grant Airmass Corporation, Stamford, CT, Product Brochure on Dyna–Care Rechargeable Air Flotation System—4 sheets.

Sunrise Medical Bio Clinic, Ontario CA, Product Brochure on Bio Therapy Plus Dynamic Air Floatation System—2 sheets.

DYNAMIC BACKREST SUPPORT SYSTEM

This is a divisional application of application having Ser. No. 08/557,906 filed on Nov. 14, 1995, now U.S. Pat. No. 5,662,384.

BACKGROUND OF THE INVENTION

1. Field of the Invention

The present invention relates to the field of dynamically inflated seating systems, and in particular, to such systems designed to provide periodic relief of pressure on selected body regions during seating.

2 . Description of Related Art

The principle of distributing the body mass of a person over a wider surface area and reducing pressures selectively through the use of cyclically applied air pressure is well known. The seated position, for patients who can tolerate it, is often preferred by clinicians for at least part of each day. It helps to drain secretions and provides maximal lung expansion and aeration, thus helping to reduce pneumonia risk. Seated positioning also improves mental orientation in elderly patients and allows a greater participation in the activities of daily living. Unfortunately, when patients at high risk for pressure sore development are placed in seated positions for longer than about ten minutes, the chance of tissue breakdown, particularly over the ischial tuberosities, coccyx and sacrum, increases substantially.

It is known to provide some relief to the region of the ischial tuberosities with a selectively inflatable cell positioned in a pelvic recess formed in a fixed-support resilient cushion, as is disclosed in U.S. Pat. No. 4,796,948 issued to Paul et al. A similar design with left and right inflatable cells is disclosed in U.S. Pat. No. 5,022,385 issued to Harza. Both of these devices provide increased support under the ischial tuberosities without removing the support from the resilient seat cushion laterally supporting the inflatable cell(s). These designs therefore provide significant pressure variation under the ischial tuberosities, but do not significantly vary the pressures occurring on the resilient cushion, which provides for a constant amount of support.

SUMMARY OF THE INVENTION

The present invention provides a seat support which provides alternating support regions by dynamic inflation of sets of cells to widely vary the pressure throughout the seat cushion surface area. In one aspect of the invention, a dynamically inflatable seat cushion provides intermittent support on the ischial tuberosities while restraining movement of the seated person toward the front of the seat.

A cushion support system according to the present invention includes a seat cushion having first and second mating sets of inflatable cells. The first set includes a pair of spaced-apart elongate longitudinal cells extending along a cushion axis corresponding to the longitudinal axis of a person supported on the support system, and a first transverse cell extending laterally between the longitudinal cells. The second set includes a pair of axially spaced inner cells positioned between the pair of longitudinal cells and separated by the transverse cell. Pressure means is provided for alternatingly inflating and deflating the first and second sets of cells so that a person seated on the seat cushion is supported primarily by alternate sets of cells.

In another aspect of the invention, the support system includes a back cushion adapted for extending upwardly along the back of a chair when the support system is positioned on a chair with the seat cushion on the chair seat. The back cushion includes two sets of interdigitated elongate lateral back cells, with tile cells in the two sets alternating in position along the cushion axis. The lateral back cells form a spinal depression extending longitudinally along at least a portion of the back cushion along the cushion axis for receiving the spine of a person supported on the support system.

In yet another aspect of the invention, the back cushion includes a pair of opposing, longitudinally extending side support cells positioned adjacent to the outer edges of the laterally extending back cells. These cells are preferably inflatable to a fixed pressure that is preferably adjustable.

In the preferred embodiment, a seating support cushion system is provided that has a seat cushion and a back cushion. The seat cushion has an H-shaped inflatable cell, with the sides of the "H" extending parallel to a cushion axis that corresponds to the longitudinal axis of a person sitting on the cushion, and therefore parallel to the thighs. The crossbar cell is midway in the cushion. A pair of inner cells fill in the "H" shape, with one cell in the rear of the cushion positioned for supporting the ischial tuberosities. This rear cell also preferably has a recess for receiving the coccyx without significant pressure and has a crossbar cell portion adjacent to the crossbar cell.

The inflation of the back and seat cells is coordinated so that the top of the pelvis is pressed forward at the same time that the inner cells are inflated. The pelvis is thus rolled forward while it is held in a stable position on the seat cushion. The preischial crossbar cells provide support and resists the tendency of the seated person to slide forward on the cushion.

Use of such a support system provides dynamic pressure reduction for a seated person, allowing persons with sacral ulcers to be maintained in a seated position when necessary for medical intervention or socialization. Likewise, persons at high risk for skin breakdown can be maintained in the seated position for a number of hours with protection against sustained high interface pressures.

These and other features and advantages of the present invention will be apparent from the preferred embodiment described in the following detailed description and illustrated in the accompanying drawings.

DETAILED DESCRIPTION OF THE PREFERRED EMBODIMENT

Structure

Figure 1:
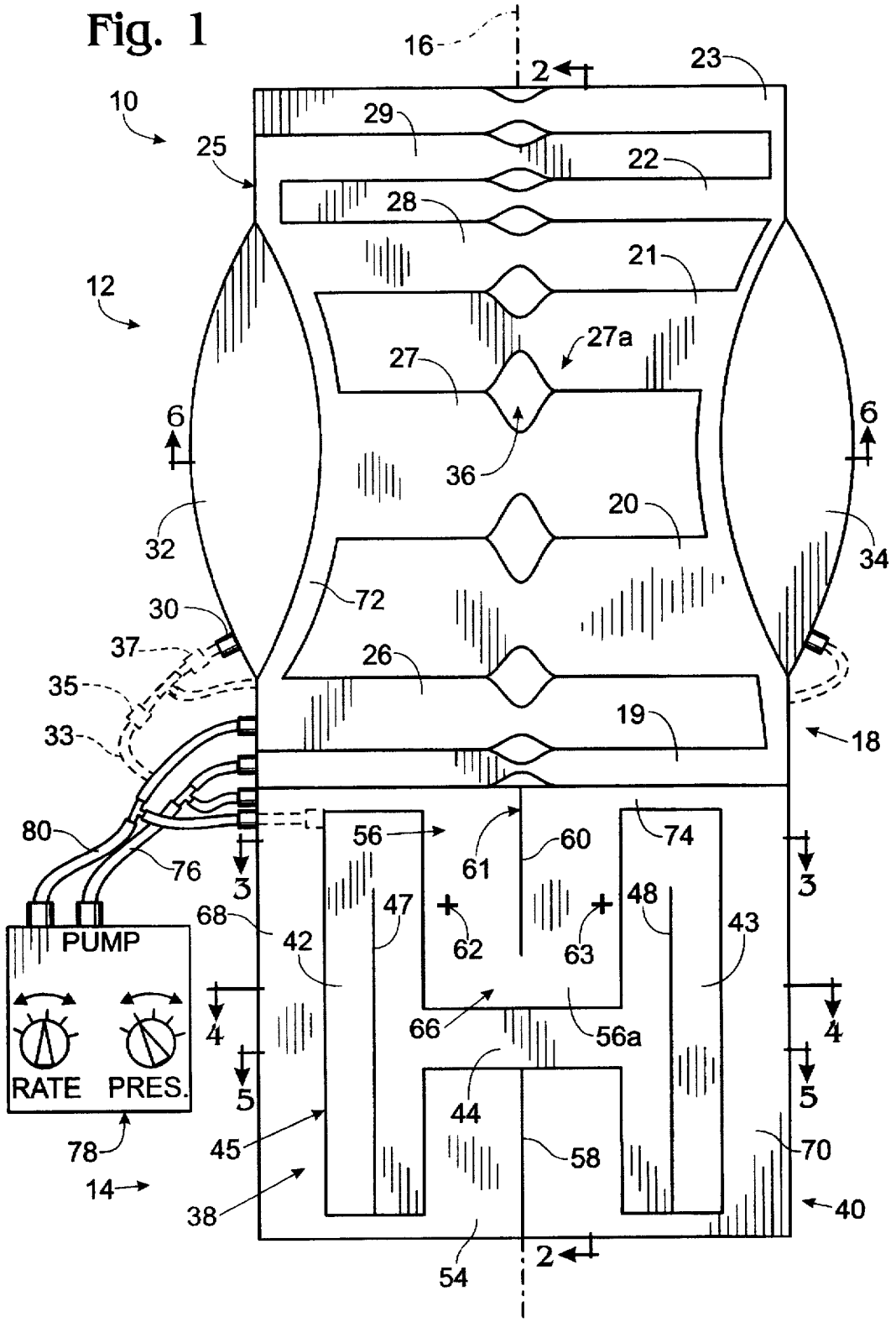
FIG. 1 is a top view illustrating the cushion support system of the invention with the back and seat cushions lying flat and uninflated.

Referring initially to FIG. 1, a seating cushion support system 10 is shown. System 10 includes back cushion 12 and seat cushion 14 which extend along a cushion axis 16 corresponding to the longitudinal axis of a person supported on the cushions. These cushions are made of a suitable flexible and sealable material, such as polyurethane, nylon or PVC, and are preferably covered by a waterproof, moisture-vapor permeable fabric, not shown. These cushions may be formed as a single unitary assembly, or as separate cushions that may or may not be connected, such as by snap connections or by releasable fabric, such as that known by the proprietary name VELCRO™. The cushions and even the cells within each cushion could also be held in a unitary assembly by a cover having pockets conforming to the associated cells. System 10 is portable, requiring a chair with a fixed back and seat, such as a conventional wheel chair or geri-chair. It will also fit on many types of conventional chairs.

Back cushion 12 has a first set 18 of laterally extending compartments or cells 19, 20, 21, 22 and 23, and a second set 25 of laterally extending cells 26, 27, 28 and 29. These cells are interdigitated and vary in cross-sectional size from small at the top and bottom and large in the middle, as shown.

Figure 6:
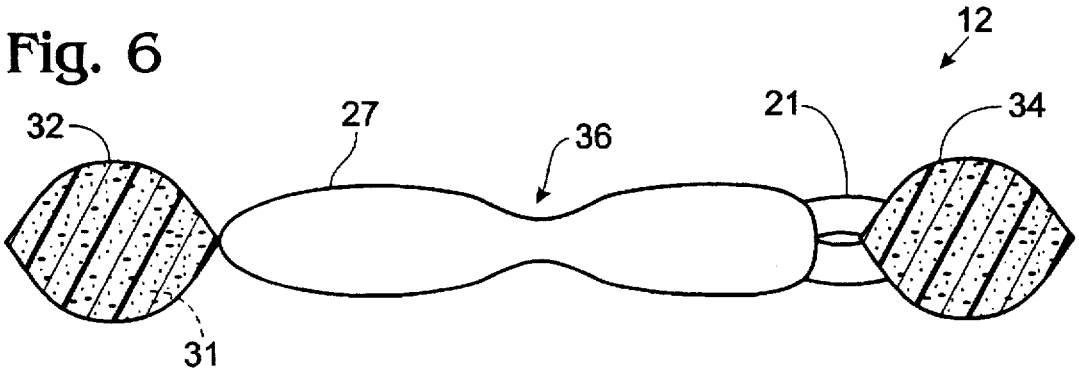
FIG. 6 is a cross section taken along line 6—6 in FIG. 1 illustrating the general shape of an inflated back cell.

Two lateral support air cells 32 and 34 are inflatable for providing sideways support to the person's trunk. Various embodiments may be provided for inflating cells 32 and 34. One embodiment, as shown in solid lines in FIGS. 1 and 6 is to have the cells manually inflatable through manually operable valves, such as valve 30. The cells may then be inflated to a pressure selected to accommodate the desired comfort level or size of the person supported by the cushion.

Cells 32 and 34 may also be filled with a resilient foam, such as foam 31 shown in cell 32 in FIG. 6. With valves 30 for manually inflating the lateral support cells, as in the first embodiment, the cells become self-inflating when the valve is opened. Further, the cell pressure can be increased by manually further inflating the cell, or reduced by pressing out some of the air in the cell.

In a third embodiment, shown in dashed lines in FIG. 1, one of the pressurized air tubes, such as tube 80, can have a feed tube 33 connected to the lateral cells. Pressurized air is applied through a manually controlled check valve 35 until cells 32 and 34 are inflated. After inflation, the check valve is turned off and an exhaust valve 37 is then manually controlled to vent excess air if a reduced cell pressure is desired.

Alternatively to the third embodiment, the pressure provided by check valve 35 could be set manually, such as by controlling the pressure applied by a spring on a ball valve. Valve 37 is then not needed, since valve 35 maintains the lateral support cells at a desired firmness. If a continuous air supply is needed, tube 33 could be connected to tubing 76 through a second check valve as well.

Each laterally extending back cell has a generally uniform size along its length, except for a restricted region in the center, such as region 27*a* of cell 27, which is produced by a narrowing in the edges. As shown in the cross section taken along line 6—6, as shown in FIG. 6, when the back cells are inflated, the restricted region is smaller in diameter than the portions of the cell on each side of the restricted region. As a result, a recess 36 is produced that extends axially along the length of the back cushion. When a person is supported on the support system, the person's spine aligns with and is received in recess 36, avoiding excessive pressure on the bony protuberances caused by the vertebrae.

Figure 4A:
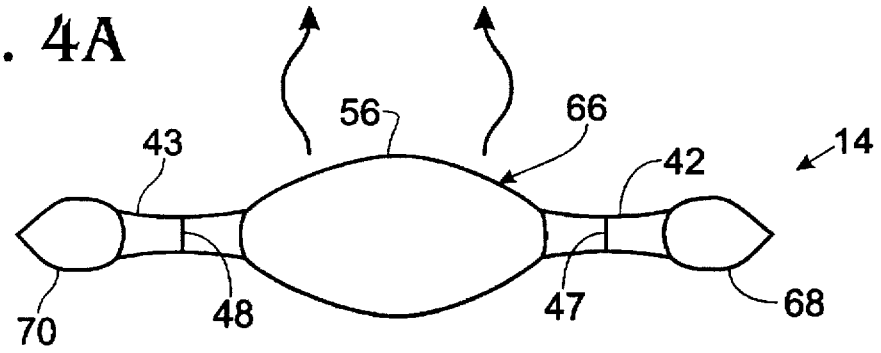
FIGS. 4A and 4B are cross sections taken along line 4—4 in FIG. 1 illustrating two alternating states of inflation of the cushion cells.
Figure 4B:
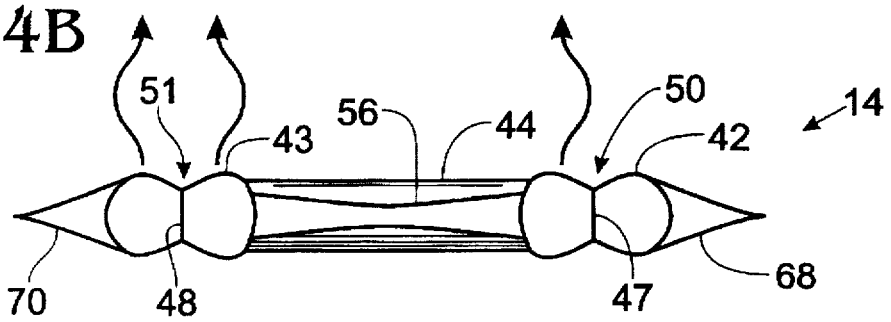
Figure 5A:
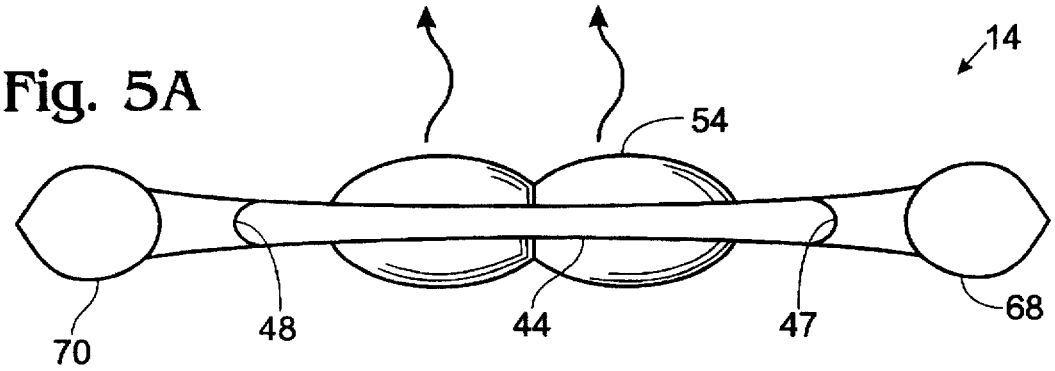
FIGS. 5A and 5B are cross sections taken along line 5—5 in FIG. 1 illustrating two alternating state of inflation of the cushion cells.
Figure 5B:
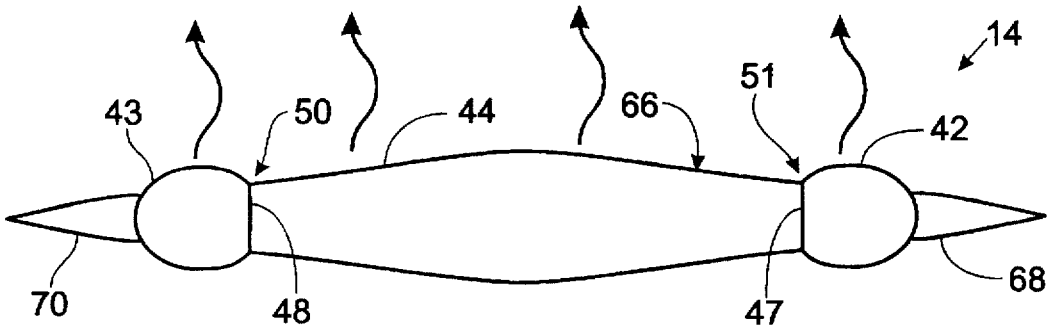

Seat cushion 14 also has two sets of cells, sets 38 and 40. Set 38 includes opposing inner longitudinal cells 42 and 43 extending along and spaced from the support axis or center of the cushion. These cells are preferably about 7½-inches apart so that they generally align with the person's thighs and support the trochanters. Interconnecting cells 42 and 43 just forward of the center of the seat is what is referred to as a preischial crossbar cell 44. Cell 44 is positioned about 8-inches from the rear of the seat so that it is forward of the ischial tuberosities of a supported person. Cells 42, 43 and 44 form, in combination a composite H-shaped cell 45. Ribs 47 and 48 extend longitudinally through the centers of inner longitudinal cells 42 and 43, respectively, for about three-fourths the length of the Cells. The ribs, in the form of I-beams, form slight recesses or grooves 50 and 51, respectively, in the surface of the cells, as shown in FIGS. 4B and 5B. The result is that the cells are flatter overall, for providing stabler support for the thighs, with enlarged rear portions for providing greater support under the buttocks.

Figure 3A:
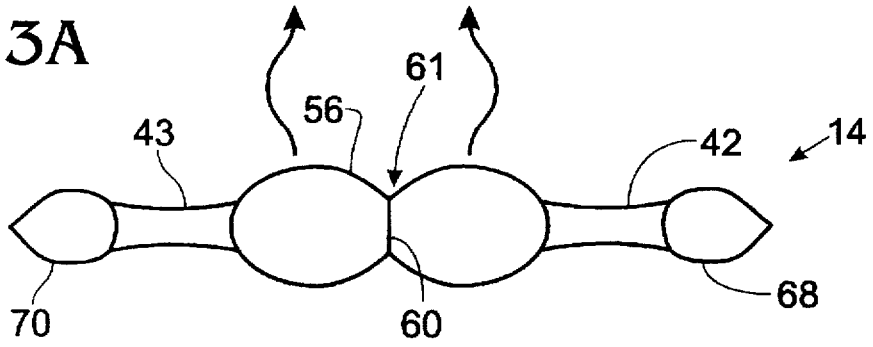
FIGS. 3A and 3B are cross sections taken along line 3—3 in FIG. 1 illustrating two alternating states of inflation of the cushion cells.

Set 40 of the cells in seat cushion 14 includes centrally located and longitudinally spaced inner or center cells 54 and 56. These cells fill the space between inner longitudinal cells 42 and 43 and are separated axially by crossbar cell 44. Forward center cell 54 has a rib 58 extending along its length and rear center cell 56 has a rib 60 extending along the rear three-fourths of the cell. Rib 60 is about half as high as ribs 47, 48 and 58, thereby producing a pronounced groove or recess 61, as shown in FIG. 3A. Recess 61 is centrally located at the rear of the seat cushion for receiving and applying minimal pressure to the coccyx of a seated person. The rear cell is preferably about eight inches long and 7½ inches wide. This results in the ischial tuberosities of an adult being located at approximately the sites 62 and 63 identified by the "+" symbols. These sites are preferably located about five inches from the rear of the seat cushion and about six inches apart.

The forward section 56*a* of rear center cell 56 adjacent to crossbar cell 44 is not restricted by a rib. Section 56*a*, as shown in FIG. 4A, forms a secondary crossbar cell 66. Cell 66, which could also be made as a separate cell from cell 56, is enlarged relative to the rear portion of cell 56 having rib 60, as shown in FIG. 3A. Cell 66 functions similarly to crossbar cell 44 in inhibiting the forward sliding of a person seated on cushion 14.

Lastly, set 40 of the seat cushion also contains outer longitudinal cells 68 and 70 extending along cells 42 and 43, respectively. These cells provide lateral support to the thighs when cells 42 and 43 are deflated, as shown in FIGS. 3A, 4A and 5A.

As shown in FIG. 1, the cells in each set of cells, generally speaking, are interconnected by connecting sections, such as section 72 connecting back cells 26 and 27, or section 74 connecting cells 56 and 70. The cells in back cushion set 18 and seat cushion set 40 are inflated and deflated together through tubing 76 which conducts air from an air pump assembly 78. Similarly, tubing 80 connects sets 25 and 38 together and to the pump as shown, using conventional tubing, connectors and a T-junction.

Figure 7:
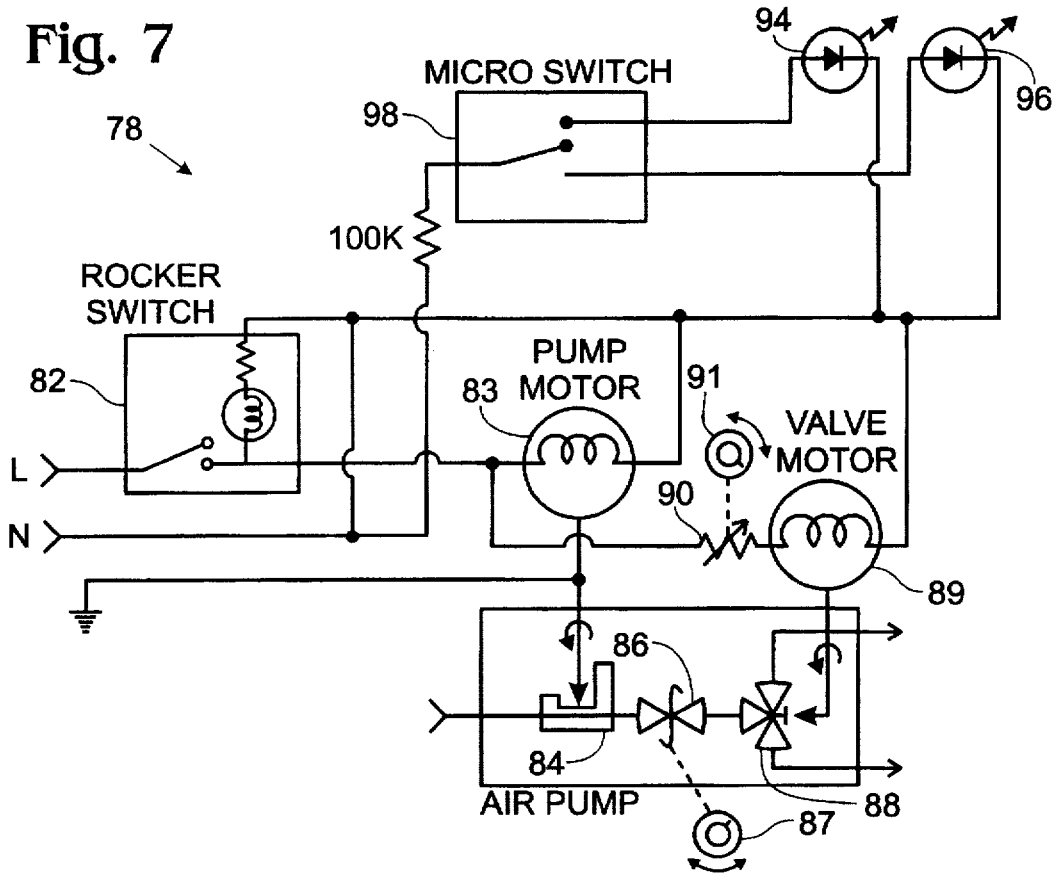
FIG. 7 is a simplified schematic of the electrical and airflow circuits of the air pump shown in FIG. 1.

As will be described, the pump cyclically inflates alternate sets of cells in each cushion. Pump assembly 78 is preferably constructed as illustrated in FIG. 7 using conventional components. A rocker switch 82 is used to turn the pump on and off. A pump motor 83 drives a reciprocating or other appropriate air pump mechanism 84. Ambient air passes into pump 84 and then passes through a controllable safety or relief valve 86. A dial 87 on a face of the pump assembly housing is coupled to valve 86 for controlling the magnitude of air pressure to be applied to the cushions. This pressure is preferably in the range of 60 mm Hg to 100 mm Hg.

The pressurized air is conducted to the cells through a two-way valve 88 driven by a valve motor 89. The current to the valve motor, which determines the speed of the motor, is controlled by a rheostat 90 in turn controlled manually by a dial 91. The speed of the valve motor determines the cycle time in switching the inflation between the respective sets of cells in the back and seat cushions.

Pressurization of the cells is shown by LEDs 94 and 96 via a micro switch 98. The micro switch is controlled by an in-line pressure sensor, not shown, with one of the LEDs indicating low pressure and the other indicating full pressure.

As has been mentioned, the cells in seat cushion 14 are preferably made of polyurethane, nylon, or PVC. These materials are air-impermeable in order to provide full inflation of the cells with a low volume of air flow. The moisture-vapor permeable fabric covering provides for a substantial amount of ventilation of the person/cushion interface. It is important to remove condensed body vapors and to cool the interface skin surface in order to minimize skin breakdown.

The ventilation and cooling of the person/cushion interface is significantly enhanced by the placement of numerous near-microscopic laser-produced holes in the central upper surface of the seat cushion. These holes allow for the escape of air from the cells generally uniformly across the upper surfaces of H-shaped cell 45 and the two inner cells 54 and 56, as illustrated in FIGS. 2A, 2B, 3A, 3B, 4A, 4B, 5A and 5B. This limits the ventilation from the cushion cells to the support areas, thereby allowing for use of a lower volume air pump than would be required if all of the cushion surfaces were air permeable. Such holes may also be provided in selected cells of the back cushion. The use of a vapor-permeable covering on the cushion further allows for dissipation of the ventilated air, as well as ventilation and cooling of the cushion surface supporting a person.

Operation

During operation after initial inflation of all of the cells, one set of cells in each of the seat and back cushions is deflated at a time. Deflation of the sets of cells is provided by releasing air through valve 88 to the atmosphere, as is conventionally known. The inflation cycle is preferably between five and fifteen minutes in total duration. For therapeutic purposes, a cycle time of about ten minutes is desirable. During a single cycle, the cells in all of the sets are initially inflated. Then one set of cells in each cushion is deflated, after which all sets of cells are inflated again, and then the other set of cells in each cushion is deflated. The deflated sets of cells are then inflated to complete the cycle. In that features of the invention do not require both the seat and back cushions, operation may be for only the seat cushion or only the back cushion. System 10 may also be configured accordingly, which is to say, the features of the seat cushion may be provided in a system without a back cushion.

FIGS. 2–5 illustrate by respective figure identifiers "A" and "B" the different conditions of the sets of cells during alternate deflation periods, as viewed along cross section lines 2—2 through 5—5 in FIG. 1. The figures with the "A" identifier illustrate the state of the associated cells with the cells in only sets 18 and 40 inflated. The figures with the "B" identifier illustrate the state of the associated cells with the cells in only sets 25 and 38 inflated.

Figure 2A:
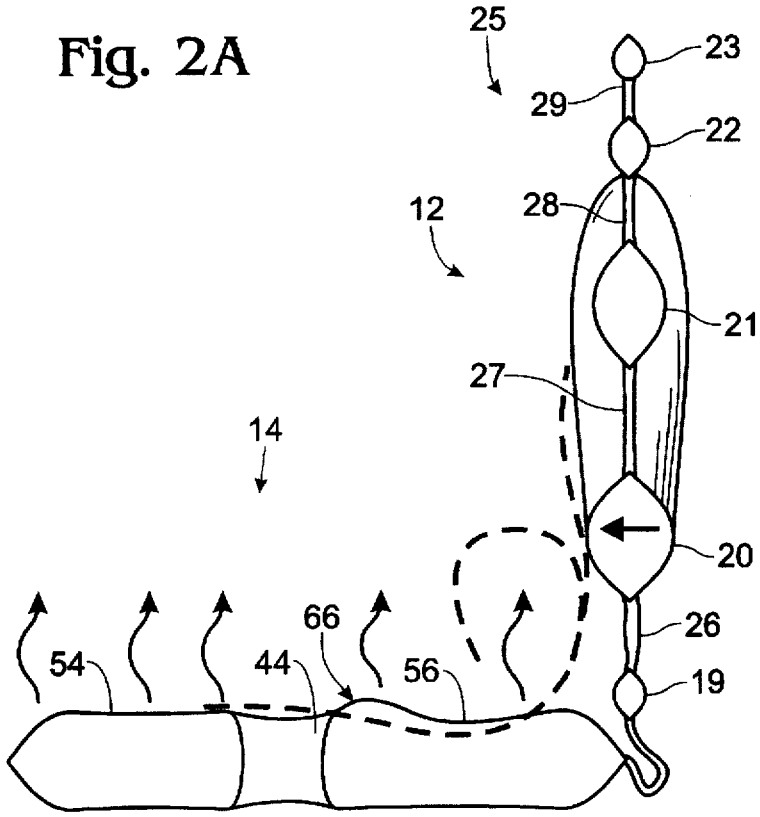
FIGS. 2A and 2B are cross sections taken along line 2—2 in FIG. 1 illustrating two alternating states of inflation of the cushion cells.
Figure 2A:
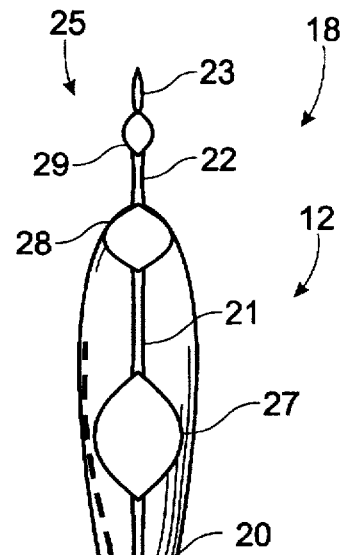
Figure 2B:
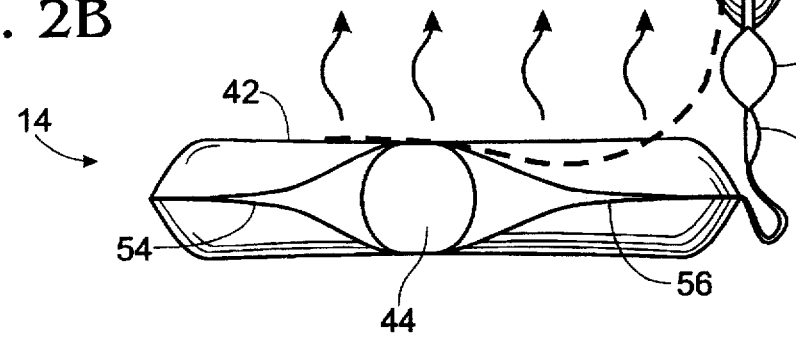

FIGS. 2A and 2B illustrate the cells along line 2—2 in FIG. 1, which shows the orientation and relationship of the back and seat cushions during use. FIG. 2A shows that when center rear cell 56 in the seat cushion is inflated for supporting directly the ischial tuberosities, back-cushion cell 20, which has an enlarged diameter compared to cell 26 just below it, is also inflated. Cell 20 is positioned at approximately the top of the pelvis.

FIG. 2B shows the cell inflation on the alternate portion of the cycle. It is seen that cell 20 provides a significant forward pressure at the top of the pelvis relative to the position of the pelvis when cells 26 and 27 are inflated. The pelvis is thus rolled forward at a time when the ischial tuberosities are well supported on inner cell 56. The forward, enlarged portion of cell 56, described above as a secondary crossbar cell 66, tends to resist forward motion of the person due to the forward motion of the pelvis due to cell 20. Support system 10 thus provides a rocking motion in the pelvis during the alternating pressure cycles, while maintaining the person in the desired position on the seat cushion.

Figure 3B:
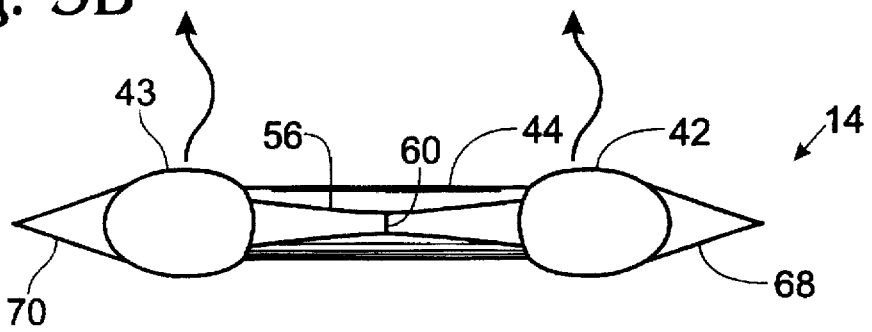

As shown in FIG. 2B, when support in the seat cushion is transferred to H-shaped cell 45, that crossbar cell 44 serves not only to support weight of the person, but also to resist movement of the person's seat forward on the seat cushion. A comparison of FIGS. 3B and 4B shows that the inner longitudinal cells 42 and 43 have enlarged regions (shown in FIG. 3B) at the rear of the cells, and that forward of these enlarged regions these cells are flatter and thinner. The enlarged regions provide increased support of the buttocks. This increased support, however, tends to urge the person forward in the seat. The crossbar cell compensates for this to hold the person substantially in a fixed position.

Figure 8A:
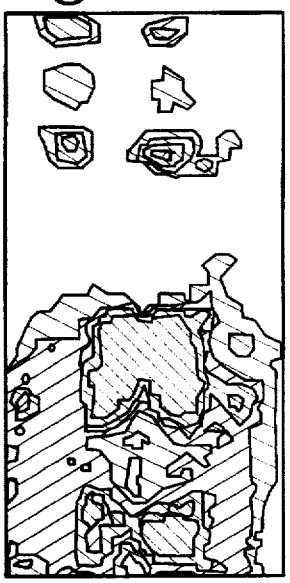
FIGS. 8A, 8B and 8C are illustrations of the pressure distribution between a person seated on the cushion support system of FIG. 1 and the seat and back cushions for three inflation states of the cushions.
Figure 8B:
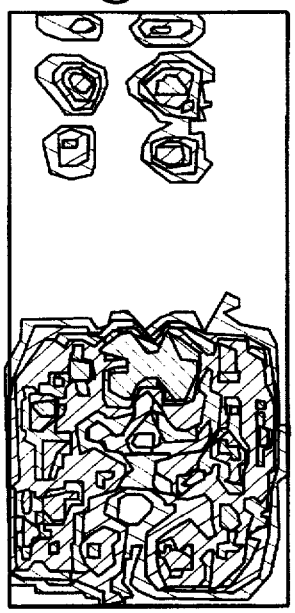
Figure 8C:
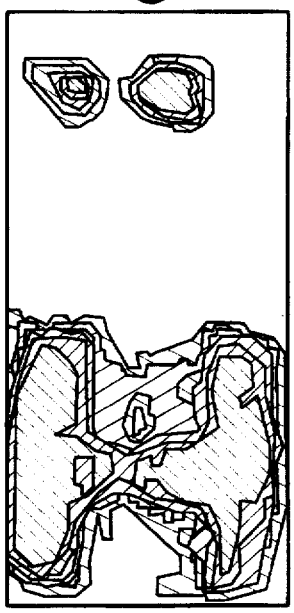

FIGS. 8A–8C illustrate the pressure distribution on a representative person seated on the cushions of support system 10 during the three phases of a support cycle. These images were produced by a commercially available pressure distribution measuring system. FIG. 8B shows the pressure distribution when all cells are fully inflated. The white areas represent no pressure, the outer dark areas represent low pressure, and the lighter internal areas represent moderate pressure. The lower portion of the image represents the seat cushion and the upper area represents the back cushion.

Addressing initially the pressures experienced on the seat cushion, with full inflation as shown in FIG. 8B, the area of greatest pressure is in the region of the ischial tuberosities. The area to the rear of the ischial tuberosities, corresponding to the position of the coccyx, has very light or no pressure in any of the images.

FIG. 8A represents the pressure distribution when only cell sets 18 and 40 are inflated. It is seen that there is relatively light pressure in the region of H-shaped cell 45, with high pressure on the two inner cells 54 and 56. The darkest regions of the image within the lighter intermediate rings indicates the location of the highest pressure. It is apparent that the greatest amount of pressure is under the pelvic region and on the ischial tuberosities.

FIG. 8C shows that when the inner seat cells 54 and 56 are deflated and the H-shaped cell 45 is inflated, there is only low pressure below the pelvic region. The heaviest pressure is along the thighs with moderate to high pressure on the preischial crossbar cell 44. The alternating inflation cycle, referencing the figures, is thus from full inflation (FIG. 8B) to partial inflation, in this case inflation of sets 18 and 40 (FIG. 8A), then back to full inflation (FIG. 8B), followed by partial inflation, now inflation of sets 25 and 38 (FIG. 8C) and back to full inflation (FIG. 8B).

Referring now to the pressure distribution associated with the back cushion, it is very apparent that there is essentially no pressure applied to the spinal column in any of the inflation states, as is indicted by the minimal pressure up the center of the back cushion. The highest pressure on the back exists when the shoulder blades are supported on inflated cell 28, as shown in FIG. 8C. This pressure is reduced to a moderate level when all the cells are inflated, as shown in FIG. 8B, and reduced to a low level when cell 28 is deflated and adjacent cells 21 and 22 are inflated, as shown in FIG. 8A.

In the demonstration that produced the images in FIGS. 8A–8C, the seated person apparently was not seated as far back as possible, and therefore did not experience the forward pressure of cell 20 on the lower back, as described. This effect could be increased by increasing the size of this cell if experience indicates that people do not sit with the pelvis as close to the lower back cushion as intended, in order to obtain the full benefits of system 10.

Although the present invention has been described in detail with reference to a particular preferred embodiment, persons possessing ordinary skill in the art to which this invention pertains will appreciate that various modifications and enhancements may be made without departing from the spirit and scope of the claims. For instance, enlarged cell regions in the preferred embodiment could be provided as separate cells, and cells having ribs could be formed as separate cells. The back-cushion cells could be provided as spaced-apart pairs of cells, with one cell of each pair on each side of the center. This construction would also form spinal recess 36. There are many variations in the structure of the cushions that could produce the same or similar support surfaces. The above disclosure is thus intended for purposes of illustration and is not limitation.

What is claimed is:

1. A dynamically inflatable support system comprising:

a back cushion adapted for extending upwardly along the back of a chair, the back cushion including first and second sets of interdigitated elongate laterally extending back cells, with the cells in the two sets alternating in position along the cushion axis, at least a portion of the back cells having intermediate portions of reduced size which form a spinal depression extending longitudinally along at least a portion of the back cushion along the cushion axis for receiving the spine of a person supported on the support system; and pressure means for alternatingly inflating and deflating the first and second sets of cells.

2. A support system according to claim 1 wherein the back cushion further comprises a pair of opposing, longitudinally extending side support cells positioned adjacent to the outer edges of the laterally extending back cells, the side support cells being inflatable separately from the first and second sets of cells.

3. A support system according to claim 2 wherein the side support cells are self-inflating.

4. A support system according to claim 2 further comprising means coupling the pressure means to the side support cells for inflating the side support cells.

5. A support system according to claim 4 wherein the coupling means includes control means for controlling the pressure in the side support cells.

6. A support system according to claim 4 Wherein the coupling means maintains the inflation pressure of the side support cells.

7. A support system according to claim 6 wherein the coupling means provides continuous inflation of the side support cells.

8. A dynamically inflatable support system comprising:

a back cushion adapted for extending upwardly along the back of a chair, the back cushion including first and second sets of interdigitated elongate laterally extending back cells, with the cells in the two sets alternating in position along the cushion axis, and a pair of opposing, longitudinally extending side support cells positioned adjacent to the outer edges of the laterally extending back cells, the side support cells being inflatable separately from the first and second sets of cells; and pressure means for alternatingly inflating and deflating the first and second sets of cells.

9. A support system according to claim 8 wherein the side support cells are self-inflating.

10. A support system according to claim 8 further comprising means coupling the pressure means to the side support cells for inflating the side support cells.

11. A support system according to claim 10 wherein the coupling means includes control means for controlling the pressure in the side support cells.

12. A support system according to claim 10 wherein the coupling means maintains the inflation pressure of the side support cells.

13. A support system according to claim 12 wherein the coupling means provides continuous inflation of the side support cells.

* * * * *